United States Patent [19]

Muehleisen

[11] 4,424,791

[45] Jan. 10, 1984

[54] PASSIVE BOWSTRING RELEASE MECHANISM

[76] Inventor: Paul Muehleisen, 3 Elkshead Ter., Yardville, N.J. 08620

[21] Appl. No.: 385,989

[22] Filed: Jun. 7, 1982

[51] Int. Cl.[3] ..... F41B 5/00

[52] U.S. Cl. ..... 124/35 A

[58] Field of Search ..... 124/35 R, 35 A, 24 R, 124/23 R, 41 R

[56] References Cited

U.S. PATENT DOCUMENTS

| | | | |
|---|---|---|---|
| 2,417,791 | 3/1947 | Tyszkiewicz . | |
| 2,637,311 | 5/1953 | Rose . | |
| 3,565,467 | 4/1972 | Halter . | |
| 3,661,136 | 5/1972 | Bradshaw . | |
| 3,757,763 | 9/1973 | Pinti et al. | 124/35 A |
| 3,768,456 | 10/1973 | Hansen et al. . | |
| 3,853,111 | 12/1974 | Stanislawski et al. . | |
| 3,898,974 | 8/1974 | Keck . | |
| 3,916,868 | 11/1975 | Wolfe . | |
| 3,954,095 | 5/1976 | Lewis | 124/35 A |
| 3,965,884 | 6/1976 | Killian . | |
| 4,086,904 | 5/1978 | Suski et al. . | |
| 4,170,216 | 10/1979 | Wilson . | |

*Primary Examiner*—Richard J. Apley
*Assistant Examiner*—William R. Browne
*Attorney, Agent, or Firm*—Frederick A. Zoda; John J. Kane

[57] ABSTRACT

A passive bowstring release mechanism is disclosed which includes a securement arm pivotally mounted with respect to a housing. The housing has a slot extending down the foremost edge thereof into which the securement arm is pivotally secured. The housing also defines a slot extending vertically downward therethrough in the edge of the housing adjacent to the longitudinal slot. A bowstring may be positioned extending vertically through the vertical slot of the housing and will be retained therein by the holding section of the securement arm. This holding section includes a concave surface adapted to abut the string and maintain it in position while the securement arm is maintained in the retaining position. A handle portion of the securement arm is adapted to be contacted by the thumb of the user to thereby hold the bowstring in place extending through the slot and locked therein by the concave surface of the holding section of the securement arm. For release of the bowstring, the thumb of the user will move away from the handle section of the securement arm allowing the slight flexing of the bowstring to cause the securement arm to pivot toward the releasing position and allowing the bowstring to contact the convex area of the holding section allowing complete and passive release of the bowstring from the release mechanism.

8 Claims, 6 Drawing Figures

PASSIVE BOWSTRING RELEASE MECHANISM

BACKGROUND OF THE INVENTION

1. Field of the Invention

The present invention deals with the field of devices usable for holding a bowstring. Conventionally, a bowstring is drawn backward by the first three fingers of a user or bowman with the arrow between the index and middle finger. Such hand held archery has been shown to be somewhat inaccurate and these results have been shown in both hunting and target shooting. For this reason it has been proved beneficial to not have the actual hand of the bowman in contact with the bowstring at the moment of release. Many triggering mechanisms have been designed to achieve a quick and non-interacting release of the bowstring.

2. Description of the Prior Art

A number of patents have been granted on devices for triggering the release of bowstrings. Examples of such patents are: U.S. Pat. Nos. 2,417,791; 2,637,311; 3,656,467; 3,661,136; 3,757,763; 3,768,456; 3,853,111; 3,898,974; 3,916,868; 3,965,884; 4,086,904, and 4,170,216.

None of the above listed patents shows that passive type of release capable with the present invention. There is also no lateral force and the only pressure necessary to hold the bowstring in the retained position is pressure necessary for the slight bending of the bowstring between the concave surface of the pivotally movable arm and the slot defined in the housing.

SUMMARY OF THE INVENTION

The present invention provides a bowstring release mechanism which is passive and allows a minimum amount of interaction between the hand of the user and the bow and bowstring device. This passive bowstring release mechanism includes a housing having two gripping apertures extending therethrough to aid in the holding of the bowstring release mechanism by the user. The housing also defines a longitudinal side cavity along one of the lateral edges thereof. The housing also further defines a vertical slot extending in the vertical direction through the housing in a position adjacent to the longitudinal side cavity.

A securement arm is pivotally mounted with respect to the housing means at a location within the longitudinal side cavity to thereby be movable between a retaining position and a releasing position. The retaining position holds the bowstring extending through the vertical slot and the releasing position allows release of the bowstring from the vertical slot means.

The securement arm includes a handle section which is movable into a position within the longitudinal side cavity. The handle section is located in this position when the securement arm is in the retaining position. When the securement arm is in the releasing position the handle section extends outside of the cavity since it has been released by removal of the thumb of the user from the handle section.

The securement arm further includes a holding section having a concave surface adapted to abut the bowstring. This concave surface and the holding section itself are pivotally movable into and out of the vertical slot to selectively engage and selectively hold a bowstring extending vertically therethrough.

The bowstring release mechanism further includes a pivot means which is adapted to pivotally secure the securement arm with respect to the housing. The pivot means preferably inclues a pivot pin extending through a housing hole means defined in the housing and extending through an arm hole means defined in the securement arm. The housing hole means and the arm hole means preferably are registered vertically with respect to one another to allow the pivot pin to extend therethrough and facilitate pivotal movement of the securement arm with respect to the housing. In this manner the pivot pin provides the fulcrum for this pivotal movement.

The holding section preferably includes a convex surface immediately adjacent to the concave surface to facilitate release of a bowstring as the securement arm means pivots from the retaining position to the releasing position. Preferably the concave surface of the securement arm means is in abutment with respect to the bowstring extending through the vertical slot and is adapted to urge the bowstring slightly laterally into the longitudinal side cavity. This lateral movement of the bowstring provides a slight tension thereon to help it be retained in position in the retaining position and also to provide an initial impetus for movement when the securement arm is released.

In order to minimize the amount of lateral pressure on the passive release mechanism, it is desirable that the pivot means be laterally oriented coincidental with the axis of a bowstring extending through the vertical slot. This lateral alignment minimizes the pressure on the thumb of the user and in particular the only pressure which the thumb of the user will be subjected to, it is that amount of pressure necessary to slightly bend the bowstring from the vertical slot into the longitudinally extending slot.

To prevent the loss of the item during hunting and other such activities, it is desirable to provide a string aperture and a string means which may be secured about the wrist of the user. In this manner the device will not be misplaced or lost during such hunting activities.

It is an object of the present invention to provide a passive bowstring release mechanism which is relatively inexpensive.

It is an object of the present invention to provide a passive bowstring release mechanism which includes minimal maintenance requirements.

It is an object of the present invention to provide a passive bowstring release mechanism having merely a single moving part.

It is an object of the present invention to provide a passive bowstring release mechanism which includes no laterally exerting forces thereon due to the axis of the release flipper and the axis of a bowstring extending through the device being coincidental laterally.

It is an object of the present invention to provide a passive bowstring release mechanism wherein a minimum amount of force need be exerted by the user on the release trigger.

It is an object of the present invention to provide a passive bowstring release mechanism which is easy to reconnect merely by sliding the bowstring upon a curved outer edge of the housing thereof.

It is an object of the present invention to provide a passive bowstring release mechanism which is easy to use with gloves on.

It is an object of the present invention to provide a passive bowstring release mechanism which can be used in target shooting.

It is an object of the present invention to provide a passive bowstring release mechanism which can be used in hunting activities and hunting environments.

It is an object of the present invention to provide a passive bowstring release mechanism which minimizes interaction between the hand of a user and the release operation of a bowstring.

It is an object of the present invention to provide a passive bowstring release mechanism which easily and quickly increases the accuracy capability of a user.

It is an object of the present invention to provide a passive bowstring release mechanism which is usable by either a left-handed person or a right-handed person without any modification whatsoever to the device.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
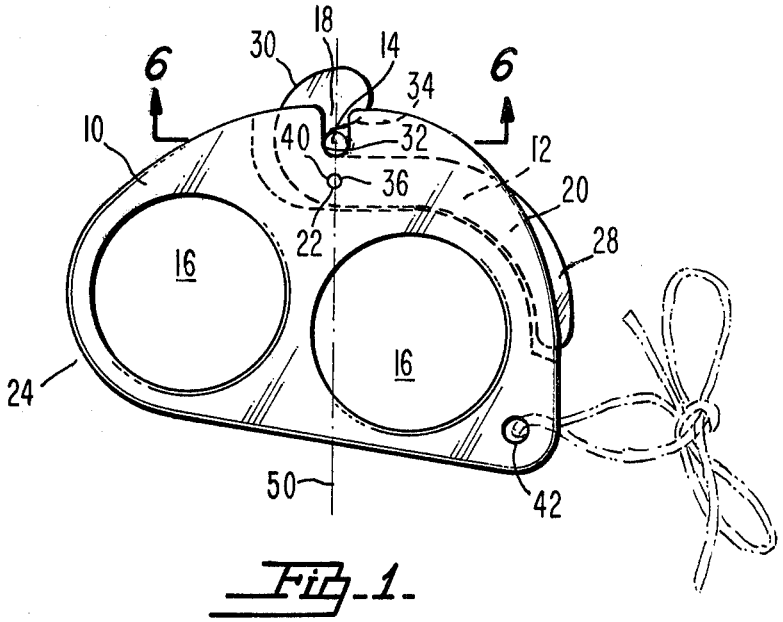
FIG. 1 is a bottom plan view of an embodiment of a passive bowstring release mechanism of the present invention shown in the retaining position.

The present invention provides a bowstring release mechanism which is passive in limiting interaction between the fingers of the user or bowman and the bowstring 14. The passive bowstring release mechanism includes a housing 10 having two gripping apertures 16 extending vertically therethrough which are adapted normally to receive the index finger and midle finger of a user. A securement arm means 12 is pivotally secured with respect to housing 10. The housing 10 defines a longitudinal side cavity 20 extending along one side thereof and a vertical slot means 18 extending vertically downward therethrough. The vertical slot means 18 extends through an edge such that the vertical slot extends through the longitudinal side cavity 20.

Securement arm means 12 is preferably pivotally secured with respect to the housing means 10 by way of a pivot means 22. The securement arm 12 is preferably pivotally secured with respect to the housing 10 within the longitudinal side cavity 20. Pivot means 22 may take the form of a pivot pin 40 extending through a housing hole means 36 and an arm hole means 38. With the housing hole means 36 being vertically registered with respect to the arm hole means 38 the pivot pin 40 when extending therethrough will achieve this pivotal relationship of movement between the housing means 10 and in particular the longitudinal side cavity 20 and the securement arm 12.

This pivotal movement will cause the securement arm 12 to be movable between a retaining position 24 which holds the bowstring 14 securely within the vertical slot means 18 and a release position 26 allowing complete release of bowstring 14.

The securement arm 12 is held in the retaining position 24 by way of a handle section 28 thereof. Handle section 28 can be held by the thumb 48 of a user causing the securement arm 12 to be held in the retaining position 24 shown best in FIGS. 1 and 6.

Figure 6:
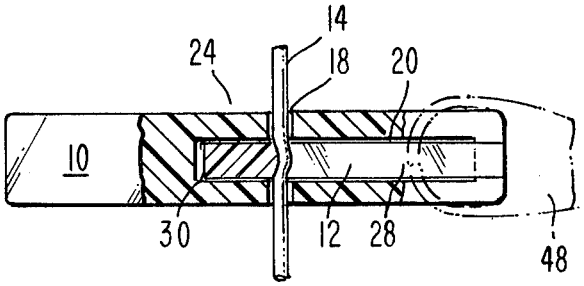
FIG. 6 is a front cross-sectional view of an embodiment of a passive bowstring release mechanism of the present invention shown in the retaining position.

The securement arm includes a holding section 30 at the end opposite from the handle section 28. Holding section 30 preferably includes a concave surface 32 which is adapted to extend within the vertical slot means 18 when the securement arm 12 is in the retaining position 24. The concave surface is adapted to abut the bowstring 14 and cause it to bend laterally slightly into the longitudinal side cavity 20 out of the vertical slot means 18. This slight lateral bending is shown in FIG. 6. This slight lateral bending provides an initial impetus to movement upon removal of the thumb of a user from the handle section 28 of the securement arm 12 to allow an initial slight momentum to be given to the securement arm 12 to aid it in moving from the retaining position 24 toward the releasing position 26.

Figure 2:
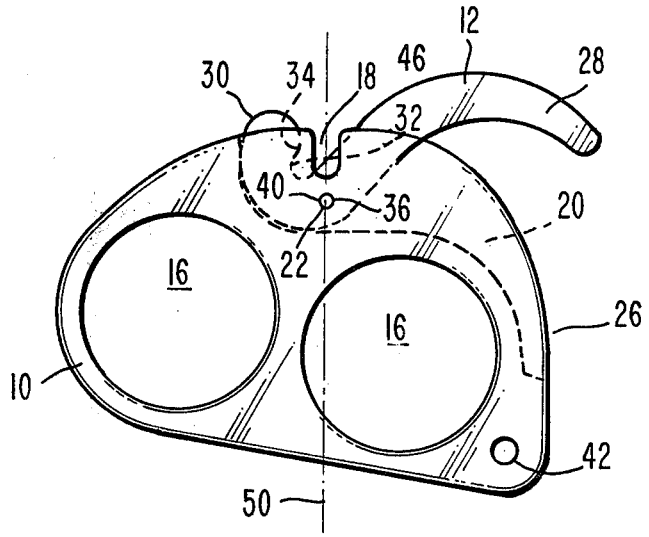
FIG. 2 is a bottom plan view of an embodiment of a passive bowstring release mechanism of the present invention shown in the releasing position.

To further facilitate movement from the retaining position 24 to the releasing position 26 a convex surface 34 may be positioned adjacent to the concave surface 32. After the initial momentum is given to rotation of the securement arm in the counter-clockwise direction as shown in FIGS. 1 and 2, the surface of bowstring 14 will contact the concave surface and thereby increase or accelerate the rate of pivotal movement of the securement arm 12 in the counter-clockwise direction.

It is then this combination of bias which causes movement of the securement arm to the releasing position. The initial impetus is provided by the slight lateral bending of the bowstring 14 shown best in FIG. 6 and the continuing acceleration of movement is caused by the contact between the bowstring 14 and the convex surface 34. In this manner a smooth and non-interacting release of a bowstring is achievable and thereby providing a very passive bowstring release mechanism for the present invention.

When the thumb 48 of the user is placed adjacent to the handle section 28 of securement arm 12 it is desirable to minimize the amount of pressure needed to hold the bowstring 14 in place. The present invention greatly minimizes the required pressure due to the lateral alignment between the pivot pin 40 and the axis of a string extending through vertical slot means 18. This is shown best in FIGS. 1 and 2 with the center line 50 shown extending through both figures. The axis of a string will be very close to the axis of the pivot pin and in this manner there will be no lateral force. The only force which will be exerted on the thumb 48 of the user will be that necessary in order to slightly bend the bowstring 14 as shown in FIG. 6. The present invention also provides great ease in placement of a string into the locking position. The securement arm 12 can be rotated counter-clockwise and the bowstring 14 can be placed into the vertical slot means 18 followed by clockwise rotation of the securement arm 12. This simple operation locks the bowstring 14 into the retaining position 24. Alternatively, it has been found that by causing the bowstring to contact the locking edge 46 as shown in FIG. 1, and merely moving the bowstring with repect to the housing 10 it is posible to instantly snap the string into position. This ease of securement facilitates hunting, especially when it is often desirable to prepare the bow and arrow for shooting instantly. Locking edge 46 provides this ease in securement.

Also, particularly usable when hunting the housing may include a string aperture 42 extending therethrough and adapted to receive a string means 44 therethrough. This string means may then be secured to the clothing or wrist of a hunter or target bowman to prevent loss of the passive bowstring release mechanism of the present invention after a shot has been executed.

Figure 3:
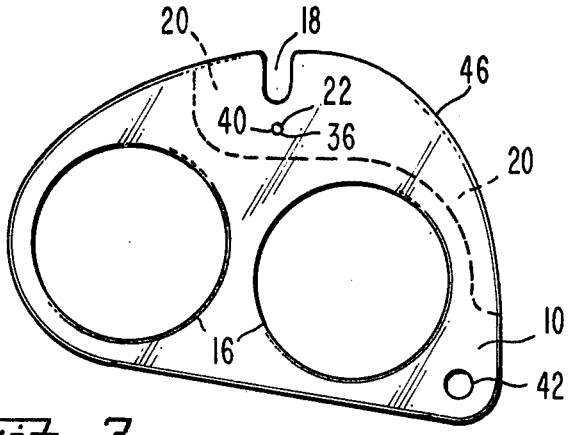
FIG. 3 is a bottom plan view of an embodiment of a housing of a passive bowstring release mechanism of the present invention.
Figure 4:
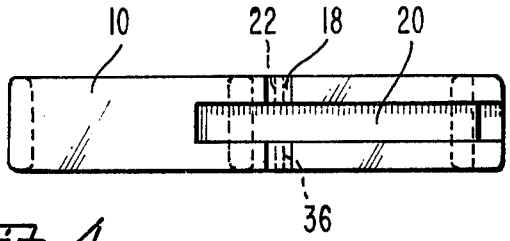
FIG. 4 is a side plan view of the embodiment shown in FIG. 3.
Figure 5:
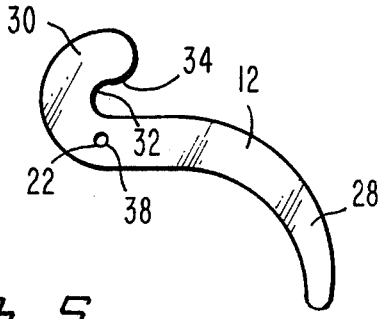
FIG. 5 is a top plan view of an embodiment of a securement arm means of the present invention.

The FIGS. 1, 2, and 3 have been described as bottom plan views, however, that only pertains to the present device when utilized by a right-handed person. When utilized by a left-handed person, these views would be top plan views. The ability of the present device to be used by either a right-handed person or a left-handed person without any modification whatsoever to the device itself, is one of the prime advantages of the present design.

While particular embodiments of this invention have been shown in the drawings and described above, it will be apparent, that many changes may be made in the form, arrangement and positioning of the various elements of the combination. In consideration thereof it should be understood that preferred embodiments of this invention dislcosed herein are intended to be illustrative only and not intended to limit the scope of the invention.

I claim:

1. A passive bowstring release mechanism comprising:

(a) a housing means defining gripping aperture means extending therethrough to facilitate holding of the bowstring release mechanism by a user, said housing means defining a longitudinal side cavity along a lateral edge thereof, said housing means further defining a vertical slot means extending vertically through said housing means and through said longitudinal side cavity;

(b) a securement arm means pivotally secured with respect to said housing means within said longitudinal side cavity to be movable between a retaining position, for holding a bowstring extending through said vertical slot means, and a releasing position, allowing release of a bowstring from said vertical slot means, said securement arm means including a handle section movable between the position within said longitudinal side cavity, when said securement arm means is in the retaining position, and a position outside of said longitudinal side cavity, when said securement arm means is in the releasing position, said securement arm means further including a holding section including a concave surface being pivotally movable into and out of said vertical slot means to selectively engage and selectively hold a bowstring extending vertically therethrough responsive to pivotal movement of said securement arm means; and (c) a pivot means pivotally attaching said securement arm means with respect to said housing means and said longitudinal side cavity, the axis of said pivot means being parallel to and laterally aligned with respect to the axis of said vertical slot means to minimize that force exerted upon said securement arm means urging same to move toward the releasing position.

2. The passive bowstring release mechanism as defined in claim 1 wherein said housing means defines a housing hole means extending vertically therethrough and said securement arm means defines an arm hole means extending therethrough and positioned in vertical registration with respect to said housing hole means, and wherein said pivot means includes a pivot pin extending vertically through said arm hole means and said housing hole means to provide a fulcrum for pivotal movement between said housing means and said securement arm means.

3. The passive bowstring release mechanism as defined in claim 1 wherein said holding section of said securement arm means includes a convex surface immediately adjacent to said concave surface to facilitate release of a bowstring as said securement arm means pivots from the retaining position to the releasing position.

4. The passive bowstring release mechanism as defined in claim 1 wherein said concave surface of said securement arm means is in abutment with respect to a bowstring extending through said vertical slot means and urging the bowstring slightly laterally into said longitudinal cavity responsive to said securement arm means being in the retaining position to provide an initial resilient impetus of movement to said securement arm means toward the releasing position responsive to release of said handle section thereof.

5. The passive bowstring release mechanism as defined in claim 1 wherein said gripping aperture means comprises two adjacently positioned gripping apertures adapted to receive the index finger and middle finger of a user to conveniently allow for the thumb of the user to selectively retain and release said handle section of said securement arm means.

6. The passive bowstring release mechanism as defined in claim 1 wherein said holding section and said handle section of said securement arm means are integral with respect to one another.

7. The passive bowstring release mechanism as defined in claim 1 further including a string aperture extending through said housing and a string means extending therethrough.

8. A passive bowstring release mechanism comprising:

(a) a housing means defining two gripping apertures extending therethrough to facilitate holding of the bowstring release mechanism by a user, said housing means defining a longitudinal side cavity along a lateral edge thereof, said housing means further defining a vertical slot means extending vertically through said housing means and through said longitudinal side cavity, said housing means further defining a housing hole means extending vertically therethrough;

(b) a securement arm means pivotally secured with respect to said housing means within said longitudinal side cavity to be movable between a retaining position, for holding a bowstring extending through said vertical slot means, and a releasing position, allowing release of a bowstring from said vertical slot means, said securement arm means including a handle section movable between a position within said longitudinal side cavity, when said securement arm means is in the retaining position, and the position outside of said longitudinal side cavity, when said securement arm means is in the releasing position, said securement arm means further including a holding section integral with respect to said handle section and including a concave surface being pivotally movable into and out of said vertical slot means to selectively engage and selectively hold a bowstring extending vertically therethrough responsive to pivotal movement of said securement arm means, said securement arm means further defining an arm hole means extending therethrough and positioned in vertical registration with respect to said housing hole means, said holding section of said securement arm means including a convex surface immediately adjacent to said concave surface to facilitate release of a bowstring as said securement arm means pivots from the retaining position to the releasing position, said concave surface of said securement arm means being in abutment with respect to a bowstring extending through said vertical slot means and urging the bowstring slightly laterally into said longitudinal cavity responsive to said securement arm means being in the retaining position to provide an initial resilient impetus of movement to said securement arm means toward the releasing position responsive to release of said handle section thereof;

(c) a pivot means pivotally attaching said securement arm means with respect to said housing means and said longitudinal side cavity, said pivot means including a pivot pin extending vertically through said arm hole means and said housing hole means to provide a fulcrum for pivotal movement between said housing means and said securement arm means, said pivot pin being positioned such as to be laterally aligned with respect to the axis of a bowstring extending through said vertical slot means.

* * * * *